US005899239A

United States Patent [19]

Coulis

[11] Patent Number: 5,899,239

[45] Date of Patent: May 4, 1999

[54] TUBULAR FENCING COMPONENTS FORMED FROM PLASTIC SHEET MATERIAL

[75] Inventor: Mark Lawrence Coulis, Brunswick, Ohio

[73] Assignee: Associated Materials, Incorporated, Akron, Ohio

[21] Appl. No.: 08/593,411

[22] Filed: Jan. 29, 1996

[51] Int. Cl.[6] ..... F16L 9/12

[52] U.S. Cl. ..... 138/163; 138/165; 138/167; 138/170

[58] Field of Search ..... 138/156, 163, 138/165, 167, 170

[56] References Cited

U.S. PATENT DOCUMENTS

| | | | |
|---|---|---|---|
| 207,606 | 9/1878 | Ketcham . | |
| 697,955 | 4/1902 | Thompson | 138/170 |
| 1,034,483 | 8/1912 | Mills . | |
| 1,796,015 | 3/1931 | Francis et al. . | |
| 1,891,740 | 12/1932 | Westerman | 138/165 |
| 1,984,232 | 12/1934 | Peremi et al. | 138/165 |
| 2,522,097 | 9/1950 | Cookson | 138/156 |
| 2,703,110 | 3/1955 | Curtis | 138/156 |
| 2,749,155 | 6/1956 | Kinghorn et al. | 138/156 |
| 2,975,874 | 3/1961 | Pagan | 138/163 |
| 3,154,037 | 10/1964 | Mayrath | 138/170 |
| 3,656,515 | 4/1972 | Wögerbauer et al. | 138/DIG. 11 |
| 3,728,837 | 4/1973 | Kiefer, Jr. . | |
| 4,725,463 | 2/1988 | Baumber et al. . | |
| 4,727,702 | 3/1988 | Baker et al. . | |
| 4,788,088 | 11/1988 | Kohl . | |
| 5,100,109 | 3/1992 | Robbins, III . | |
| 5,215,290 | 6/1993 | Khalessi . | |
| 5,303,900 | 4/1994 | Zulick, III et al. . | |
| 5,421,556 | 6/1995 | Dodge et al. . | |

*Primary Examiner*—Denise L. Ferensic
*Assistant Examiner*—James F. Hook
*Attorney, Agent, or Firm*—Banner & Witcoff, Ltd.

[57] ABSTRACT

Tubular components for use in modular fencing systems are manufactured utilizing die-forming of a flat plastic sheet, rather than by profile extrusion of a tubular form. This approach is made feasible by an aesthetically acceptable and structurally sound longitudinal edge joint configuration. The joint is formed by cooperating clip members formed along opposing longitudinal edges of the sheet. The clip members are interlocked with each other in overlapping relation following the die-forming operations. The clip members are substantially concealed by peripheral side portions of the component that are held in closely spaced or abutted relation. Structural integrity is assured by staking overlapping portions of the clip members to each other at longitudinally spaced locations. This can be accomplished with a thin circular blade having teeth that rotate to pass between the peripheral side portions and to press against and deform the overlapping portions, one into the other. In addition to allowing substantially higher rates of production and material savings (as compared with profile extrusion methods), the technique facilitates the formation of wood-simulating graining and color variegation.

9 Claims, 6 Drawing Sheets

TUBULAR FENCING COMPONENTS FORMED FROM PLASTIC SHEET MATERIAL

BACKGROUND OF THE INVENTION

The present invention relates to plastic fencing components. In particular, the invention relates to elongated tubular plastic fencing components, e.g., posts, pickets and rails used in modular plastic fencing systems, and improved methods for manufacturing the same.

Plastics present a desirable alternative to wood as a construction material for fencing, particularly in terms of ease of use and durability. For example, modular vinyl (PVC) fencing is generally easy to assemble, highly resistant to the elements and does not require painting. The use of plastics for fencing components is known, e.g., in the agricultural, residential and home improvement industries. Exemplary plastic fencing structures are disclosed in U.S. Pat. Nos. 5,421,556 (Dodge et al.)(commonly assigned); 5,303,900 (Zulick, III et al.); 5,215,290 (Khalessi); 4,727,702 (Baker et al.); and 3,728,837 (Kiefer, Jr.).

The conventional technique for manufacturing tubular plastic fencing components involves the use of profile extrusion, i.e., the extrusion of molten plastic material into the desired tubular profile. At least three significant problems exist with this technique. First, the flow characteristics of plastics materials such as PVC require that the extrusion be performed with relatively low throughput, e.g., 12–15 feet per minute (fpm). Obviously, if the throughput could be increased, production costs would be reduced, thus making plastic fencing an even more viable substitute for wood.

Secondly, profile extrusion of tubular structures inherently requires that certain minimum wall thicknesses be maintained to prevent collapse or warpage of the extruded plastic material while it is still soft. This results in unnecessary material usage, and expense, since the wall thicknesses will be dictated by the production process rather than the requirements of the product's end use. Since, for many fencing applications, adequate strength can be afforded with significantly thinner walls than are required by profile extrusion methods, there is a need for an alternative manufacturing method that would allow formation of lesser wall thicknesses.

Finally, an important concern for many potential purchasers/users of plastic fencing is whether the fencing has a natural appearance, i.e., whether it closely simulates a natural wood fence. Toward this end, it is desirable to provide plastic fencing with a simulated wood grain, and color variegation. However, it is difficult to impart such attributes to tubular fencing components produced by profile extrusion.

The formation of pipe and other tubular structures from sheet metal is known. Typically such processing involves the use of stamping, rolling and/or die-forming to create a generally tubular shape having a pair of adjacent or overlapping longitudinal edges. Some form of crimping or separate connectors are generally used to secure the longitudinal edges to each other to finish the tube. Examples of such techniques are disclosed in U.S. Pat. Nos. 1,796,015 (Francis et al.); 1,034,483 (Mills); and 207,606 (Ketchum).

Heretofore, such forming processes have not provided a viable substitute for profile extrusion in the production of plastic fencing. Principally, what has been lacking is a satisfactory means for producing an aesthetically acceptable and structurally sound longitudinal edge joint as part of a relatively high-speed continuous production process.

SUMMARY OF THE INVENTION

In view of the foregoing, it is a principal object of the present invention to provide a method of continuously manufacturing plastic fencing components with relatively high throughput.

Another object of the invention is to provide a method of manufacturing plastic fencing components that facilitates the introduction of surface graining and color variegation, to create a natural wood-like appearance.

Yet another object of the invention is to provide a method of manufacturing plastic fencing components that affords material savings through the use of lesser wall thicknesses.

It is a further object of the present invention to provide die-formed fencing components including an aesthetically acceptable and structurally sound longitudinal edge joint.

Still another object of the invention is to provide an apparatus for efficiently producing an aesthetically acceptable and structurally sound longitudinal edge joint as part of a high-speed continuous process.

These and other objects are achieved in accordance with the present invention by a method of manufacturing a tubular fencing component. A heated elongated sheet of plastic material is fed through a die-forming apparatus such that the sheet is progressively formed into a generally tubular shape with longitudinal edge portions extending inwardly of the generally tubular shape. The edge portions terminate in respective cooperative clip members. The respective clip members are progressively interlocked with each other in overlapping relation. The interlocked clip members serve to hold peripheral side portions of the generally tubular shape, adjacent the longitudinal edge portions, together in slightly spaced or abutted relation, whereby the interlocked clip members are substantially concealed within the generally tubular shape. The interlocked hook structures are progressively bonded together by inserting a bonding tool between the peripheral side surfaces and pressing the tool against overlapping portions of the clip members.

In another aspect, the invention is embodied in an apparatus for use in the manufacture of tubular fencing components. The apparatus serves to progressively bond together overlapping portions of interlocked longitudinal edge portions of a sheet of plastic material formed into a generally tubular shape, the longitudinal edge portions extending inwardly of the generally tubular shape and being substantially concealed by peripheral side portions of the generally tubular shape, adjacent the longitudinal edge portions, held together in slightly spaced or abutted relation. The apparatus comprises feeding means for feeding the generally tubular shape along a feed path. A blade is movably mounted adjacent the feed path. The blade has an outer edge portion that is movable between the peripheral side portions to press against the overlapping portions to stake one to the other at longitudinally spaced locations.

In yet another aspect, the invention is embodied in a tool for use in staking together layers of plastic materials. The tool comprises a circular blade having a hub portion for rotatably mounting the blade, and an outer edge portion comprising spaced teeth. The spaced teeth comprise pairs of adjacent teeth extending in opposing circumferential directions of the circular blade.

In still another aspect, the invention is embodied in a tubular fencing component. The component comprises a sheet of plastic material formed into a generally tubular shape with longitudinal edge portions extending inwardly of the generally tubular shape and terminating in respective cooperative clip members interlocked with each other in overlapping relation. The interlocked clip members serve to hold peripheral side portions of the generally tubular shape, adjacent the longitudinal edge portions, together in slightly spaced or abutted relation. In this manner, the interlocked clip members are substantially concealed within the generally tubular shape. The overlapping portions of said clip members are bonded to each other along their lengths.

These and other objects, features and advantages of the present invention will become apparent and fully understood from the following detailed description of the preferred embodiments, taken in connection with the appended drawings.

DETAILED DESCRIPTION OF THE PREFERRED EMBODIMENTS

Figure 1A:
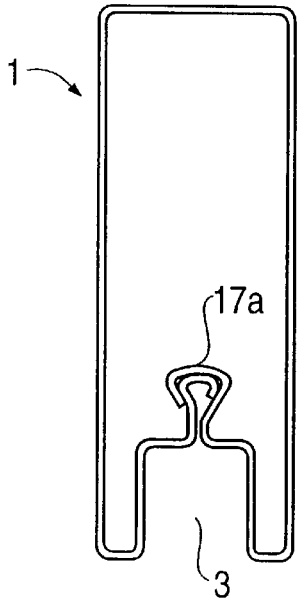
FIGS. 1A–1E are end elevational (profile) views of various tubular plastic fencing components in accordance with the present invention.
Figure 1B:
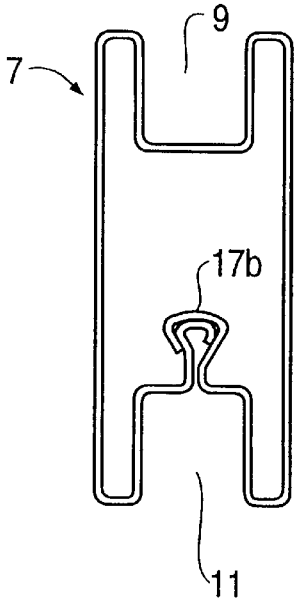
Figure 1C:
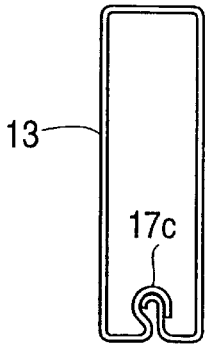
Figure 1D:
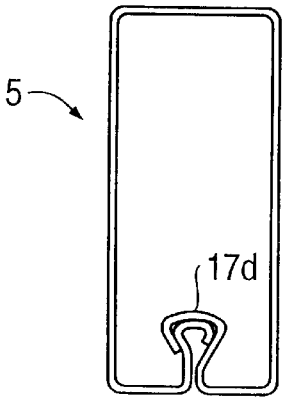
Figure 1E:
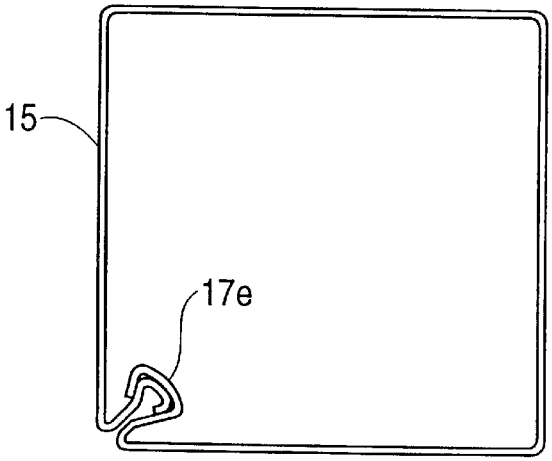

Referring first to FIGS. 1A–1E, illustrated are the profiles of several different elongated tubular fencing components in accordance with the present invention. The components are used in combination with each other, and with other components, to form modular plastic fencing systems designed to suit different needs. FIG. 1A depicts a top or bottom rail 1 having a length-wise extending recess 3 into which a vertical picket 5 (FIG. 1D) may be fit. FIG. 2B depicts an intermediate rail 7 having recesses 9,11 running along top and bottom edges, for insertion of vertical pickets 5. FIG. 1C illustrates a simpler horizontal rail structure 13 designed to be used with separate connectors for attachment to other fencing components. FIG. 1E shows a square fence post 15.

Unlike conventional profile extruded pieces, each of the components of FIGS. 1A–1E is die-formed from a flat sheet of plastic material, e.g., PVC. This is made feasible by the inclusion in each design of an aesthetically acceptable (concealed) and structurally sound longitudinal edge joint 17*a*–17*e* (to be described in detail).

Figure 2:
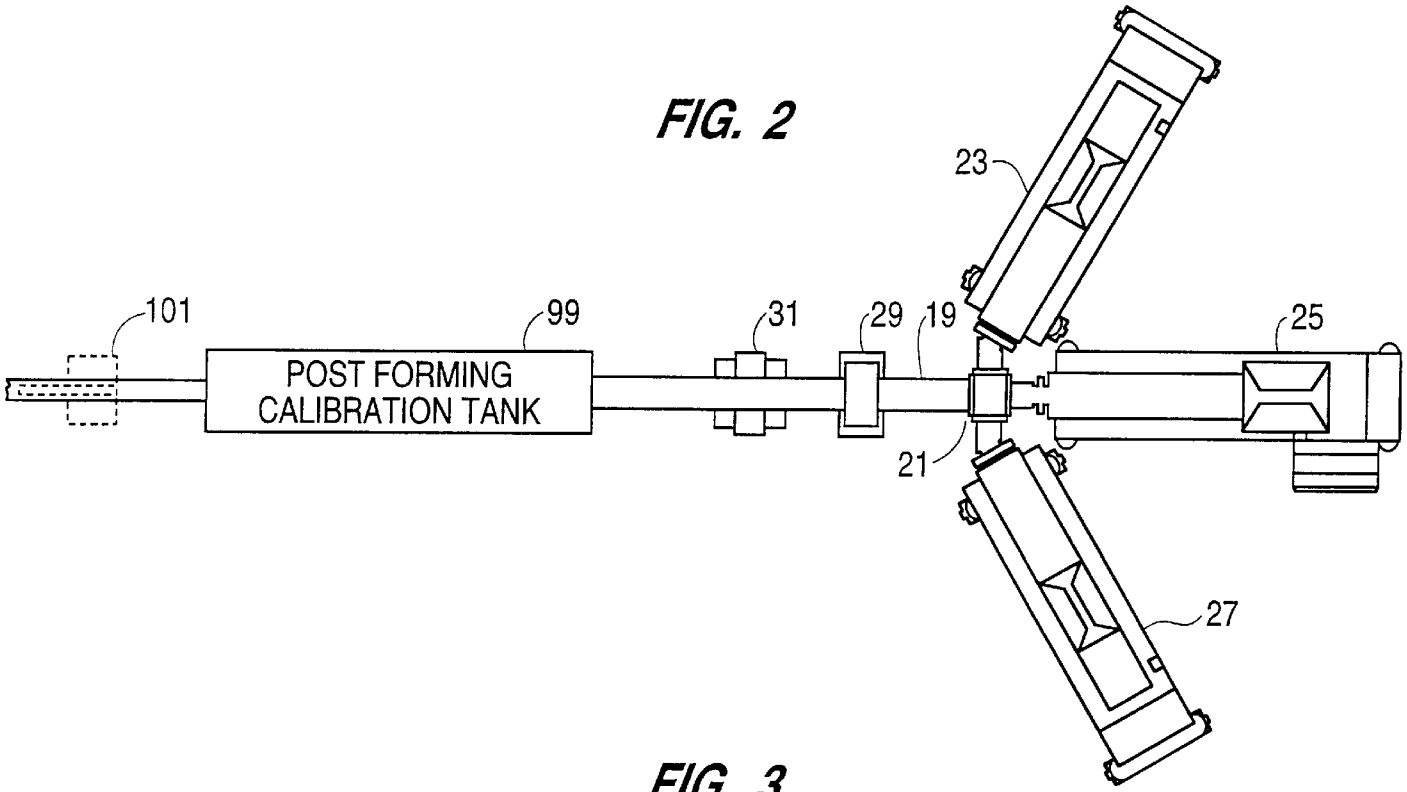
FIG. 2 is a diagrammatic top plan view of a production line for continuously manufacturing tubular plastic fencing components in accordance with the present invention.
Figure 3:
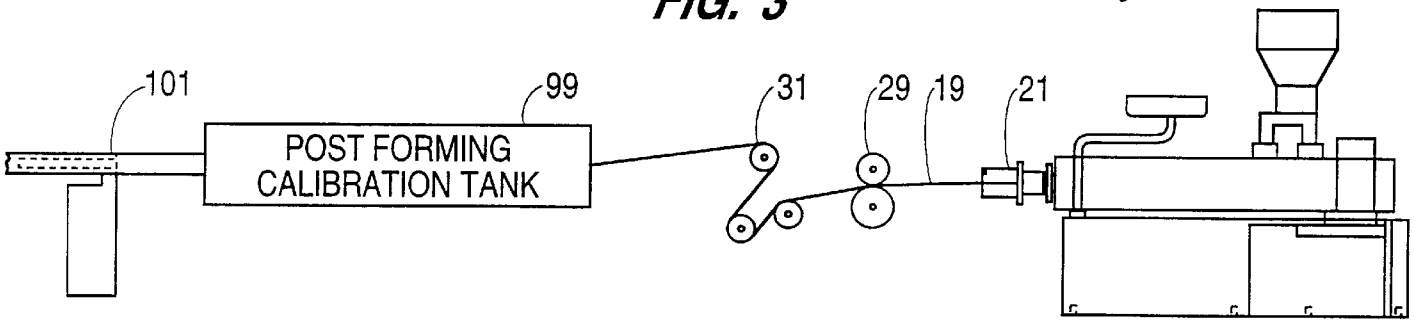
FIG. 3 is a diagrammatic side view of the production line shown in FIG. 2 (side extruders omitted for clarity).

FIGS. 2 and 3 illustrate a production line for continuously manufacturing tubular plastic fencing components in accordance with the present invention. In the preferred embodiment, the process begins with the extrusion of a monolithic substantially planar sheet of plastic material 19 out of a sheet die 21. Sheet 19 may comprise one or more layers. Sheet 19 may, e.g., comprise a separate capstock layer and substrate layer supplied to sheet die 21 from separate extruders 23, 25 at approximately 400° F. Additionally, a third extruder 27 may be used to introduce a color streaking material, in order to provide a natural wood-simulating color variegation.

The capstock material may be formulated as a weatherable exterior material and may include as its primary components PVC resin and titanium dioxide. The substrate may be formulated as a rigid underlayment material and may include as its primary components a PVC resin and an acrylic monomer.

The thickness of sheet 19 will be determined by the width of the opening of sheet die 21. With profile extrusion, a minimum wall thickness of about 0.150" is necessary to avoid collapse or warpage of a tubular structure before it fully hardens (reaches crystalline equilibrium). On the other hand, thickness is not a significant limiting factor in the extrusion of a flat sheet to be formed into fencing components. The inventor has found that a wall thickness of 0.070" is more than adequate for most fencing applications; this thickness of sheet can be extruded without difficulty. Accordingly, significant plastic material savings can be realized with the present invention.

After the extrusion process, sheet 19 is drawn down (stress relieved) at a set of rolls 29 positioned within 24" of the exit of extrusion die 21. The temperature of the sheet at this stage will typically be approximately 370° F. If desired, a surface texture pattern (e.g., simulated wood grain) may be embossed into the capstock by rolls 29, or by another set of rolls. After passing through rolls 29, plastic sheet 19 enters a cooling set of rolls 31 serving to stabilize the material temperature to approximately 280° F.

The partially cooled sheet 19 is then fed into a post (extrusion) forming calibration tank 99 wherein the sheet is progressively formed into a generally tubular shape constituting a precursor to a desired end profile (such as one of the profiles shown in FIGS. 1A–1E). Those skilled in the art will appreciate that post forming calibration tank 99 comprises a series of tool steel dies through which plastic sheet material 19 is drawn by a puller, e.g., pinch roller or the like (not shown). The dies form slot-like passageways that converge in a step or continuous fashion toward the desired end profile. The dies are submerged in a cooling liquid, e.g., water, which quickly reduces the temperature of sheet 19 to approximately 220° F. As the material passes through the dies, it is forced to conform to the die walls by a liquid vacuum applied to die interiors.

Figure 4:
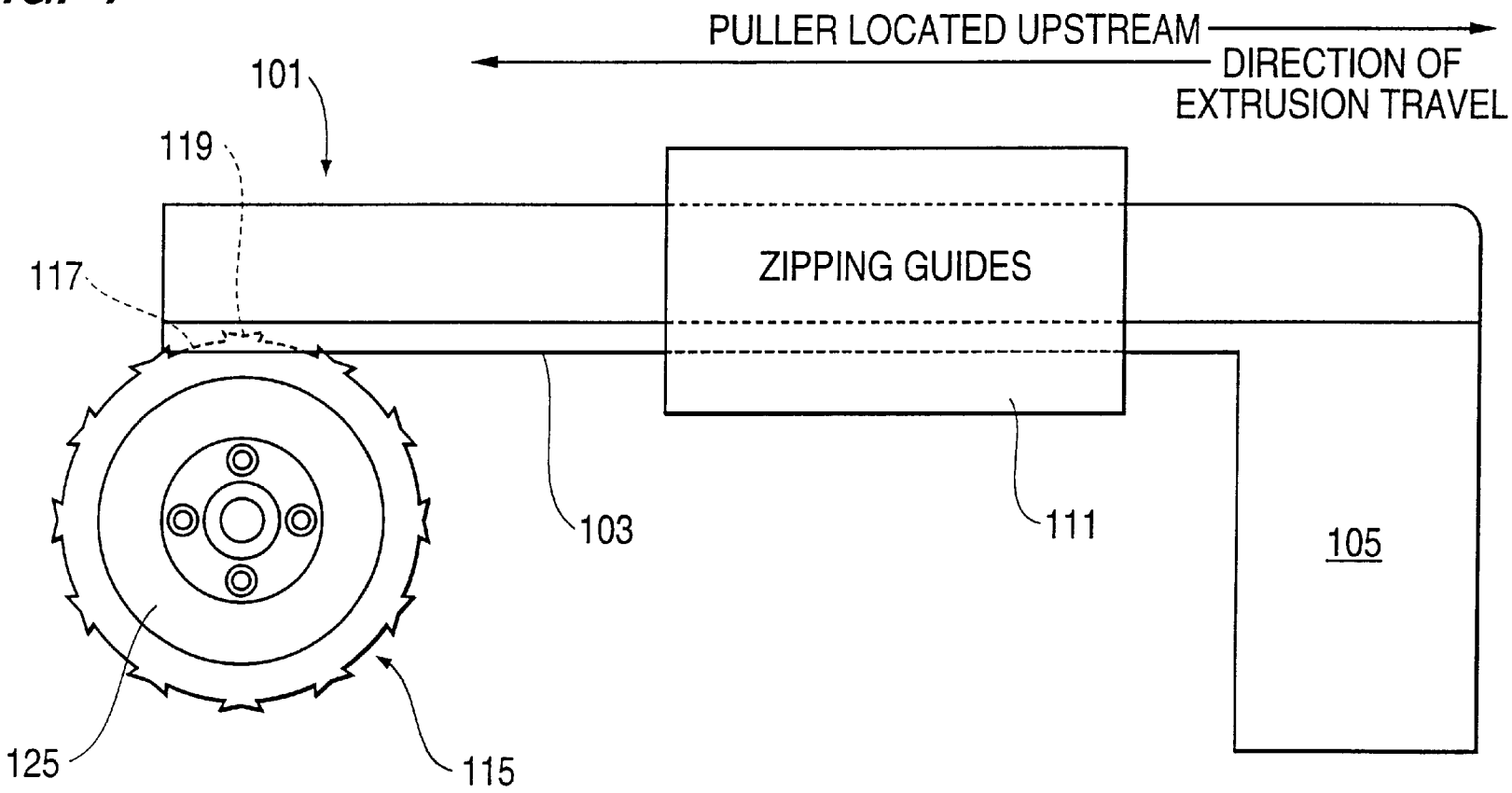
FIG. 4 is a diagrammatic side view of longitudinal edge joint zipping and staking apparatus forming final stages of the production line shown in FIGS. 2 and 3.
Figure 5:
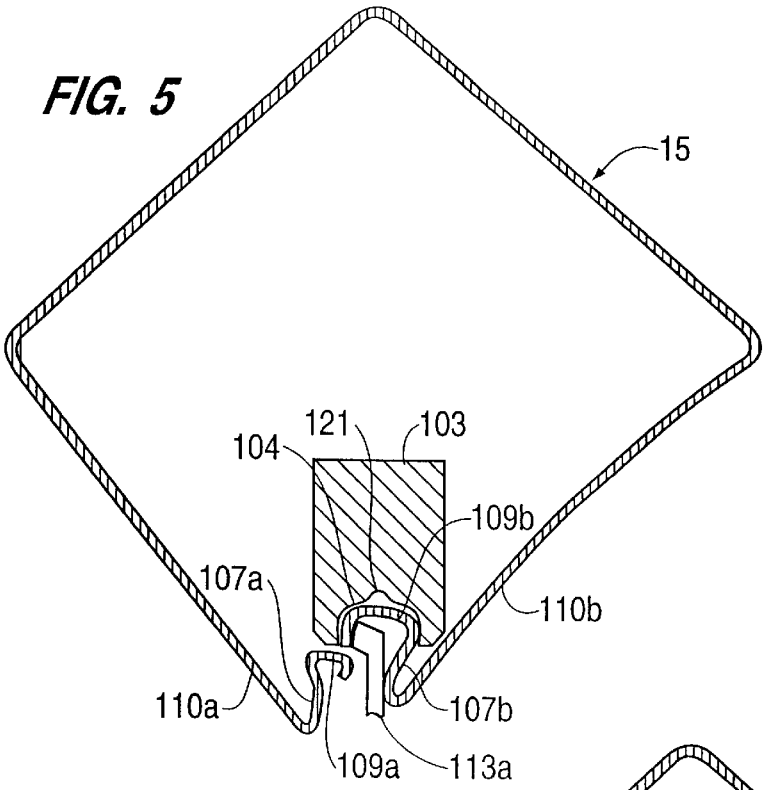
FIG. 5 is a cross-sectional view illustrating a first stage of a longitudinal edge joint zipping (interlocking) operation/apparatus of the production line shown in FIGS. 2 and 3.
Figure 6:
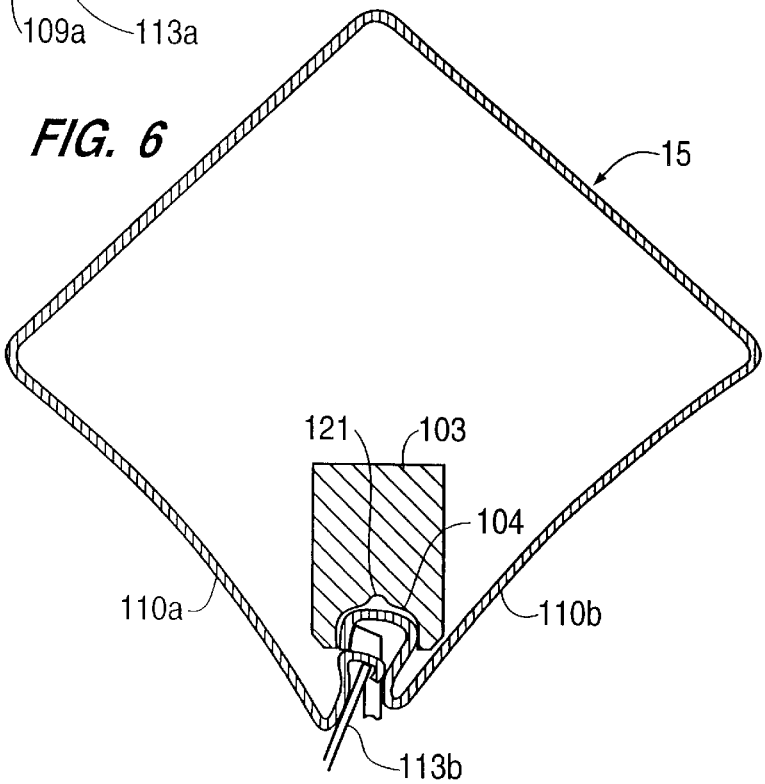
FIG. 6 is a cross-sectional view of a second stage of a longitudinal edge joint zipping (interlocking) operation/apparatus of the production line shown in FIGS. 2 and 3.

Exiting post forming calibration tank 99, sheet 19 (now cooled to about 70° F.) passes through the puller (not shown) and onto a mandrel 101, whereon operations are performed to first interlock then stake longitudinal edge joint 17 (see FIGS. 1A–1E). As best seen in FIGS. 4–6, mandrel 101 comprises a rail 103 having a channel 104 formed on its underside.

Rail 103 is cantilever mounted to a base 105. (Other arrangements may obviously be used.) As seen in FIG. 5

(illustrating formation of a post as shown in FIG. 1E), when plastic sheet 19 has left post forming calibration tank 99, it has a generally tubular shape, with longitudinal edge portions 107*a,b* terminating in respective cooperative clip members 109*a,b*. Initially, longitudinal edge portions 107*a,b* are slightly separated and pliable enough to allow the generally tubular (but slightly open) shape to pass over base 105 and onto mandrel rail 103.

Once on mandrel rail 103, the generally tubular shape passes into a "zipping" guide stage 111, wherein a series of finger-like guide members 113*a,* 113*b* (FIGS. 5–6) arranged adjacent mandrel rail 103 cooperate with the mandrel rail to progressively bring together and interlock clip members 109*a,b* in overlapping relation. Once interlocked, clip members 109*a,b* serve to hold peripheral side portions 110*a,* 110*b* of the generally tubular shape together in slightly spaced or abutted relation, thereby substantially concealing the longitudinal edge portions, including clip members 109*a,b,* from view.

From there, the closed generally tubular shape passes to a "staking" stage, wherein the overlapping portions of clip members 109*a,b* are "staked" together at longitudinally spaced locations. In the context of this application, "staking" refers generally to the creation of discrete points of attachment formed by nested deformations of one layer into the other. (In this connection, it should be noted that in its broader aspects, the invention is not limited to such staking, but also includes other forms of plastic bonding such as ultrasonic welding.) Following staking, the resultant elongated tubular shape can be cut into segments of a desired length. With the process of the present invention, throughput on the order of 45–50 fpm can be obtained. This represents a substantial increase over the 12–15 fpm throughput obtainable with profile extrusion.

Figure 10:
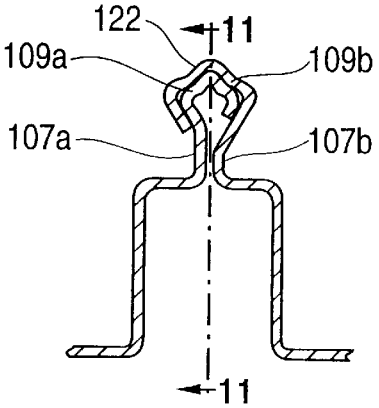
FIG. 10 is a transverse partial cross-sectional view of a tubular fencing component in accordance with the invention, showing particularly the longitudinal edge joint after it has been staked.

In accordance with the illustrated preferred embodiment, the staking apparatus comprises a circular blade 115 rotatably mounted adjacent mandrel rail 103, directly downstream of zipping guides 111. Blade 115 is sized and positioned such that an outer circumferential edge portion 117 thereof, comprising teeth 119, rotates to pass between peripheral side portions 110*a,b* and into contact with an outermost one of the overlapping portions of clip members 109*a,b*. A longitudinal slot 121 is formed within channel 104 of mandrel rail 103. Teeth 119 press the overlapping portions into slot 121 to create nested deformations (stakes) 122 (see FIGS. 10–11) serving to secure the overlapping portions against relative motion, particularly motion in the shear plane defined between the layers.

Figure 7:
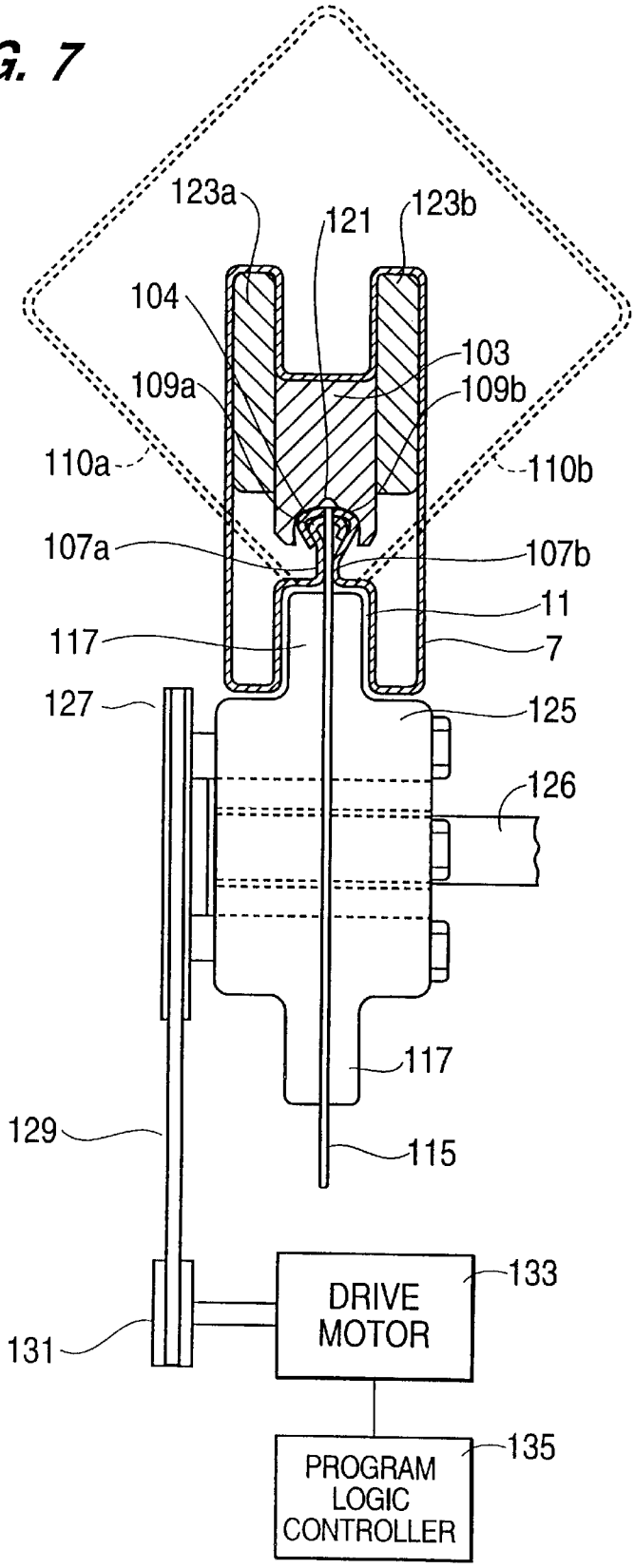
FIG. 7 is a diagrammatic cross-sectional view illustrating a longitudinal edge joint staking operation/apparatus of the production line shown in FIGS. 2 and 3.

The staking process/apparatus is seen most clearly FIG. 7. The staking of an intermediate rail 7 of the type seen in FIG. 1B is primarily illustrated, with use of the same apparatus to form a square post 15 (FIGS. 1E, 5 and 6) being depicted with hatched lines. To help support and stabilize the movement of intermediate rail 7, mandrel rail 103 is mounted between two bars 123*a,b* in such a manner as to correspond to the interior shape of rail 7. It can also be seen that a hub 125 of circular blade 115 has an outer portion 117 shaped to fit closely within recess 11.

A variety of arrangements may be used to rotatably mount and drive circular blade 115. In the illustrated exemplary embodiment, hub 125 rotatably mounts blade 115 for rotation on a stationary axle 126. Attached to an outer rotating part of hub 125 is a gear or sprocket 127 driven, through a chain 129 and drive gear 131, by a drive motor 133. The speed of drive motor 133 is controlled by a known program logic controller 135 to compensate for line fluctuations and synchronize the rotation speed of blade 115 with the feed speed of plastic material 19.

Figure 8:
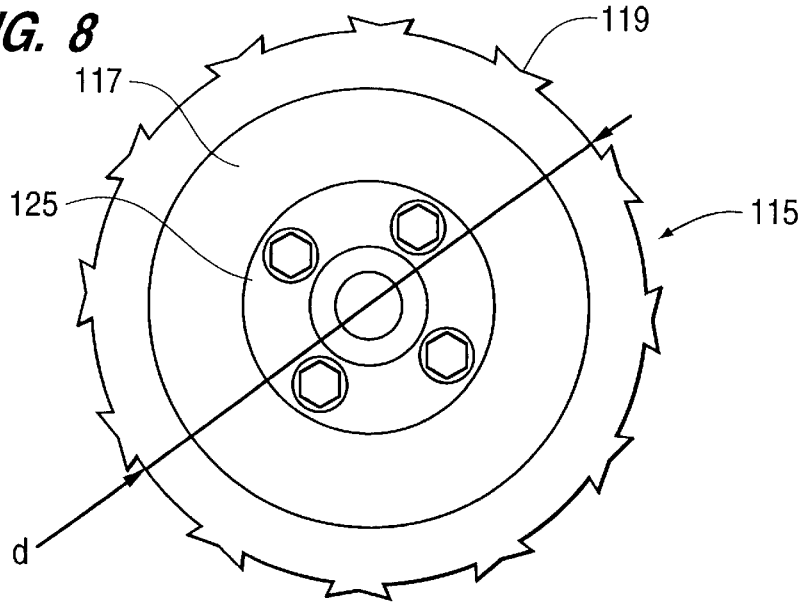
FIG. 8 is a front elevational view of a circular blade used in the staking operation/apparatus of FIG. 7.
Figure 9:
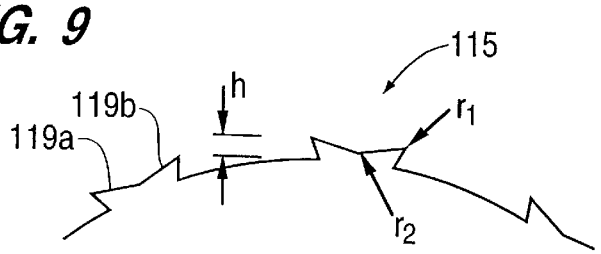
FIG. 9 is a close-up partial front elevational view depicting the teeth of the blade of FIG. 8.
Figure 11:
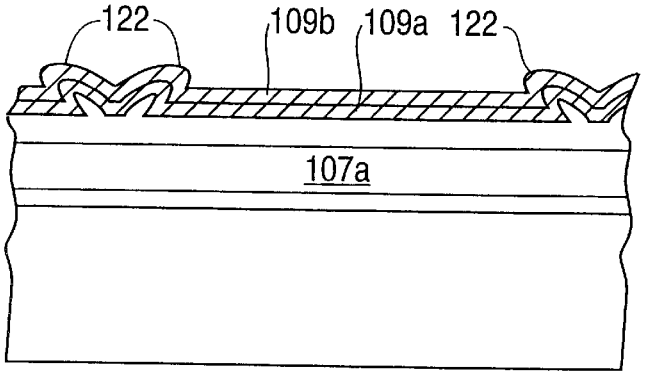
FIG. 11 is a cross-sectional view taken on line 11—11 of FIG. 10.

Referring now to FIGS. 8 and 9, teeth 119 comprise pairs of adjacent teeth 119*a,b* extending in opposing circumferential directions of blade 115. As best seen in FIG. 11, the shape of stakes 122 corresponds generally to the shape of teeth 119*a,b*. Thus, teeth 119*a,b* serve to create stakes directed in opposed longitudinal directions of the tubular fencing component. An arrangement of stakes extending in opposing longitudinal directions has been found to provide significantly increased strength (particularly in the opposing longitudinal directions) as compared with a single stake directed normally into the layers.

Various blade sizes and configurations are possible. (The invention is not limited to rotating circular blades.) Teeth 119 should be thick enough to create a strong stake. On the other hand, blade 115 should be thin enough to allow it to easily pass between the peripheral side portions (e.g., 110*a,* 110*b*) held together by interlocked clip members 109*a,b*. In a preferred embodiment, blade 115 (including teeth 119) are integrally formed from a sheet of tool steel having a thickness of 0.063". The shape and size of the teeth can also vary. In this regard, blade positioning, and tooth shapes and sizes, should be chosen such that the staking of the material deforms but does not pierce the plastic layers. Occurrences of piercing have been found to significantly reduce the attainable joint strength. As a rule of thumb, it is believed that material deformations (offsets) approximately equal to the thickness of the plastic sheet material being processed will yield good results.

In one embodiment suitable for the manufacture of a 4" square post, from PVC sheet material having a thickness of 0.070", blade 15 has a diameter d, exclusive of the teeth, of 6". Teeth 119 are configured in pairs spaced along the circumference of the blade at 1½" centers. (As a result, pairs of stakes are also spaced at 1½" centers.) Adjacent teeth of each pair are generally triangular in shape and symmetrical with respect to each other. The teeth have a height h of 0.221". The tips of the teeth are rounded to a radius $r_1$ of 0.010, and the corners between the adjacent triangular teeth are rounded to a radius $r_2$ of 0.200. The rounding of the tips of the teeth helps to provide a material offset or deformation without piercing the material, while the rounding between the teeth serves primarily to avoid stress concentrations in the blade.

The present invention has been described in terms of preferred embodiments thereof. Numerous other embodiments, features and variations within the scope and spirit of the appended claims will occur to persons skilled in the art from a review of this disclosure.

I claim:

1. A tubular construction component comprising a single sheet of plastic material formed into a generally tubular shape with longitudinal edge portions extending inwardly of said generally tubular shape and terminating in respective cooperative clip members interlocked with each other in overlapping relation, the interlocked clip members serving to hold peripheral side portions of the generally tubular shape, adjacent the longitudinal edge portions, together in slightly spaced or abutted relation, thereby forming a longitudinally extending slit between said peripheral side portions which is generally centrally aligned with the interlocked cooperative clip members, whereby the interlocked clip members are substantially concealed within the generally tubular shape, the overlapping portions of said clip members being bonded to each other along their lengths in a line substantially aligned with said longitudinally extending slit.

2. A tubular construction component according to claim 1, wherein said peripheral side portions are planar surfaces that come together to define a corner of a generally polygonal tubular shape.

3. A tubular construction component according to claim 1, wherein said peripheral side portions are planar surfaces that come together to form a recessed surface of a generally polygonal tubular shape.

4. A tubular construction component according to claim 1, wherein the overlapping portions of said clip members are bonded to each other by staking at longitudinally spaced locations.

5. A tubular fencing component according to claim 4, wherein said overlapping portions are staked to each other by pairs of nested surface deformations extending in opposed longitudinal directions of the generally tubular shape.

6. A tubular construction component comprising a single sheet of plastic material formed into a generally tubular shape with longitudinal edge portions extending inwardly of said generally tubular shape and terminating in respective cooperative clip members interlocked with each other in overlapping relation, the interlocked clip members serving to hold peripheral side portions of the generally tubular shape, adjacent the longitudinal edge portions, together in slightly spaced or abutted relation, whereby the interlocked clip members are substantially concealed within the generally tubular shape, the overlapping portions of said clip members being bonded to each other along their lengths by staking at longitudinally spaced locations.

7. A tubular construction component according to claim 6, wherein said peripheral side portions are planar surfaces that come together to define a corner of a generally polygonal tubular shape.

8. A tubular construction component according to claim 6, wherein said peripheral side portions are planar surfaces that come together to form a recessed surface of a generally polygonal tubular shape.

9. A tubular construction component according to claim 6, wherein said overlapping portions are staked to each other by pairs of nested surface deformations extending in opposed longitudinal directions of the generally tubular shape.

* * * * *